US007100619B2

(12) United States Patent
Kim

(10) Patent No.: US 7,100,619 B2
(45) Date of Patent: Sep. 5, 2006

(54) ATTACHING APPARATUS OF ARTIFICIAL NAIL

(75) Inventor: Chang-Hak Kim, Seoul (KR)

(73) Assignee: Lee Chang Enterprise Co., LTD, Seoul (KR)

( * ) Notice: Subject to any disclaimer, the term of this patent is extended or adjusted under 35 U.S.C. 154(b) by 13 days.

(21) Appl. No.: 10/505,816

(22) PCT Filed: Oct. 21, 2003

(86) PCT No.: PCT/KR03/02199

§ 371 (c)(1),
(2), (4) Date: Aug. 26, 2004

(87) PCT Pub. No.: WO2005/002388

PCT Pub. Date: Jan. 13, 2005

(65) Prior Publication Data

US 2005/0224089 A1 Oct. 13, 2005

(30) Foreign Application Priority Data

Jul. 2, 2003 (KR) ..... 20-2003-0021184 U

(51) Int. Cl.
*A45D 29/00* (2006.01)

(52) U.S. Cl. ..... 132/73; 132/73.5

(58) Field of Classification Search ..... 132/73, 132/285; 623/57

See application file for complete search history.

(56) References Cited

U.S. PATENT DOCUMENTS

| | | | | |
|---|---|---|---|---|
| 4,408,622 | A | 10/1983 | Meyerhoefer et al. | |
| 4,559,055 | A * | 12/1985 | Ogunro | 606/1 |
| 4,605,024 | A * | 8/1986 | Tremblay | 132/320 |
| 4,924,889 | A | 5/1990 | Schaeffer et al. | |
| 5,638,835 | A | 6/1997 | Franz et al. | |
| 6,293,283 | B1 * | 9/2001 | Washington | 132/73 |

FOREIGN PATENT DOCUMENTS

| | | |
|---|---|---|
| JP | 8-33512 | 2/1996 |
| KR | 107637 | 7/1997 |
| KR | 20-220261 | 2/2001 |

* cited by examiner

*Primary Examiner*—Patricia Bianco
*Assistant Examiner*—Rachel Running
(74) *Attorney, Agent, or Firm*—Merchant & Gould P.C.

(57) ABSTRACT

The present invention relates to an artificial nail, more especially to an artificial nail and an apparatus for attaching the artificial nail on a nail of human being so that it is convenient to attach and change the artificial nail an can be adjusted according to the length of the artificial nail. The apparatus for attaching an artificial nail on the natural fingernail includes a lower attaching plate attached on an upper side of the natural fingernail, and an upper attaching plate attached on a lower side of the artificial nail and combined with the lower attaching plate.

4 Claims, 10 Drawing Sheets

ATTACHING APPARATUS OF ARTIFICIAL NAIL

BACKGROUND OF THE INVENTION

1. Field of the Invention

The present invention relates to an artificial nail, more especially to an artificial nail and an apparatus for attaching the artificial nail on a nail of human being so that it is convenient to attach and change the artificial nail an can be adjusted according to the length of the artificial nail.

2. Prior Art

In recent, for the beauty, women give a great deal of effort and interest to adorn them selves with a variety of bright clothes and ornaments suited with the clothes. These ornaments are used in various styles. Among the ornaments, women give the greatest deal of effort to adorn a fingernail, one of organization of the body that is always exposed exterior. Namely, there are several typical adornments for the fingernail such as painting manicure on the fingernail, sculpting shapes on the fingernail, as well as attachment of the artificial nail having a plenty of colors and shapes on the fingernail. More especially, women have loved a long and fingernail-like-made artificial nail, which is attached on a natural fingernail.

This artificial nail can be attached on the natural fingernail by coating adhesive material on an upper side of the natural fingernail, so that almost women have loved the artificial nail. However, the attached artificial nail on the natural fingernail should be detached from the natural fingernail by chemicals so that it is inconvenient for use. Moreover, it should be required much effort and time to use the artificial nail once so that the attached artificial mail on the natural fingernail cannot be easily detached from the natural fingernail as well as the attached artificial nail must be worn for the long time even when feels repugnance.

In detail, chemicals should be used for the detachment of the artificial nail, the detached artificial nail cannot be used again, as well as there is inconvenience that the natural fingernail on which the artificial nail is attached should be token care for the attachment of other artificial nail.

In addition, the natural fingernail on which the artificial nail is attached grows as time goes, a part of the grown natural fingernail (the innermost end of the natural fingernail) must be exposed exterior, so that it must be lack of sense of beauty. Some user fills up the exposed part of the natural fingernail (the grown part of the natural fingernail) with resin or chemicals. However, the natural fingernail grows no longer time so that the grown natural fingernail should be taken care for filling up the grown part.

SUMMARY OF THE INVENTION

Therefore, the present invention is made to solve such the problems, it is an object of the invention to provide an artificial nail and an apparatus for easily attaching and changing the artificial nail various artificial nails on the user's natural fingernail according to user's favorites and interests.

It is another object of the present invention to provide an apparatus for adjusting an attachment position of an artificial nail on a natural fingernail at a state that the artificial nail is attached on the natural fingernail as much as growing length of the natural fingernail even when the natural fingernail grows by time goes so that the apparatus can be used for the long time.

In order to accomplish the object, the present invention provides an apparatus for attaching an artificial nail on the natural fingernail includes a lower attaching plate attached on an upper side of the natural fingernail, and an upper attaching plate attached on a lower side of the artificial nail and combined with the lower attaching plate.

The upper attaching plate has a supporting segment with a curvature corresponding to a curvature portion of the artificial nail and a pair of saw teeth bars having a plurality of saw teeth formed on both sided of the supporting segment in parallel.

The lower attaching plate has a front supporting segment with a curvature corresponding to a curvature portion of the natural fingernail, a pair of saw teeth bars extended from the front supporting segments in parallel with a plurality of saw teeth, and a pair of rear supporting segments formed on opposite end sides of the saw teeth bars.

Preferably, a spring member is attached on the lower side of the artificial nail.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter an apparatus for attaching an artificial nail a according to the preferred embodiment of the present invention in detail by referring to the accompanying drawings.

Figure 1:
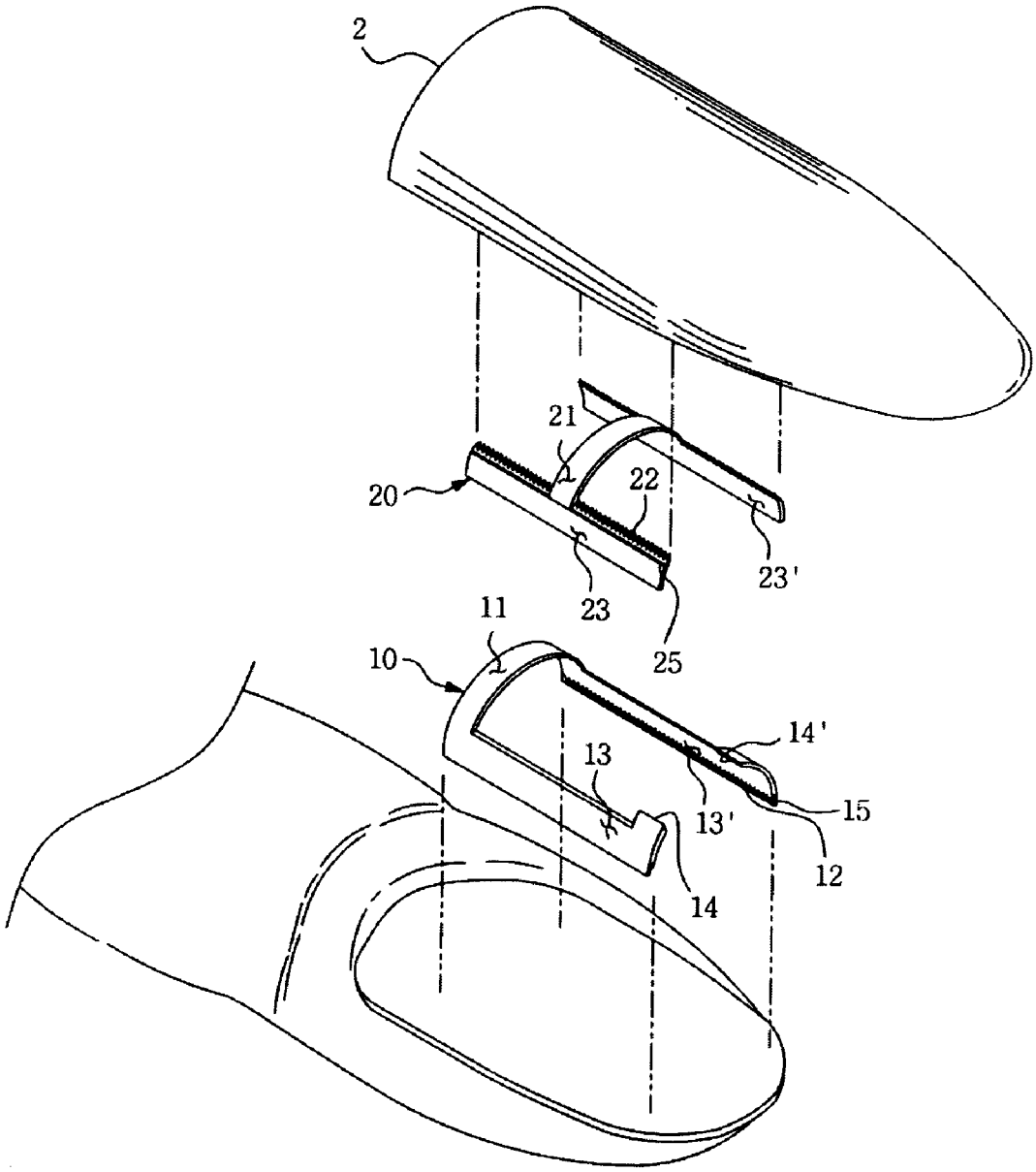
FIG. 1 is an exploded perspective view showing an apparatus for attaching an artificial nail according to a preferred embodiment of the present invention.
Figure 2A:
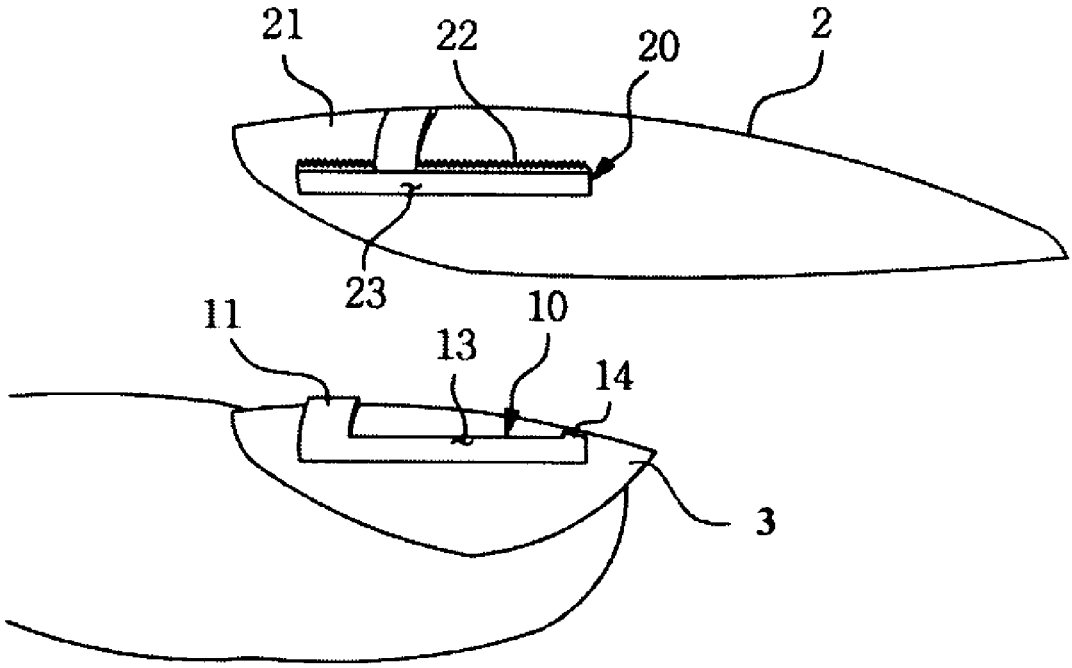
FIG. 2A is a side view showing a state that an upper and lower attaching plates of the artificial nail attaching apparatus of the present invention in FIG. 1.
Figure 2B:
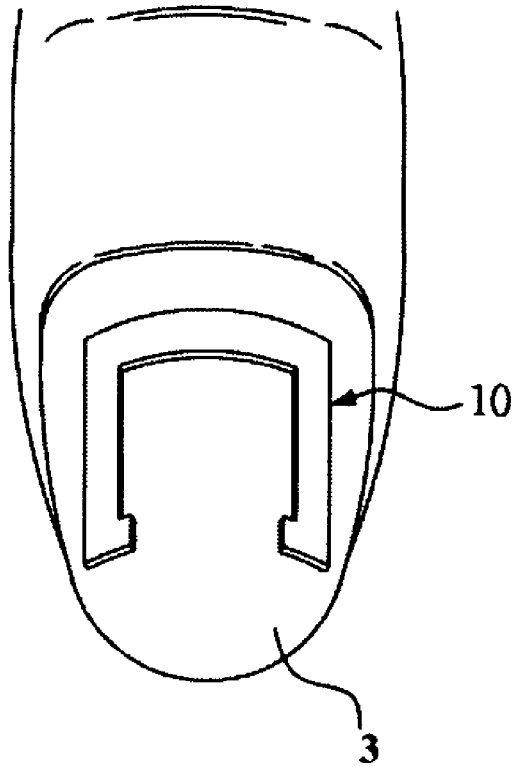
FIG. 2B is a plan view showing a state that the upper and lower attaching plates of the artificial nail attaching apparatus of the present invention in FIG. 1.

FIG. 1 is an exploded perspective view showing an apparatus for attaching an artificial nail according to a preferred embodiment of the present invention, FIG. 2A is a side view showing a state that an upper and lower attaching plates of the artificial nail attaching apparatus of the present invention in FIG. 1, FIG. 2B is a plan view showing a state that the upper and lower attaching plates of the artificial nail attaching apparatus of the present invention in FIG. 1.

As shown in FIG. 1, the artificial nail attaching apparatus 1 according to the present invention includes a lower attaching plate 10 attached on an upper side of a natural fingernail 3, and an upper attaching plate 20 attached on a lower side of an artificial nail 2. The artificial nail 2 is a conventional artificial nail having sufficient elastic force required as an artificial nail.

The structure of the upper attaching plate 20 and the lower attaching plate 10 are described in detail.

As shown in FIGS. 2A and 2B, the lower attaching plate 10 has a front supporting segment 11 having a curvature corresponding to a curvature portion of the natural fingernail 3, and a pair of saw teeth bars 13 and 13' extended from both sides of the front supporting segment 11 in parallel. The saw teeth bars 13 and 13' are formed with a plurality of saw teeth thereon. A pair of rear supporting segments 14 and 14' are extended inward from ends of the lower saw teeth bars 13 and 13' in opposite manner. The saw teeth 12, which are formed on the lower saw teeth bars 13 and 13' and arranged in a single raw, are preferably formed inside an extending portion 15 (See FIGS. 1 and 6) which is extended downward at a predetermined length from the saw teeth bars 13 and 13'.

As shown FIGS. 1 and 2A, the upper attaching plate 20 is formed with a supporting segment 21 having a curvature corresponding to a curvature portion of the artificial nail 2, and a pair of upper saw teeth bars 23 and 23' having a plurality of saw teeth extended on both sides of the supporting segment 21 in parallel.

Meanwhile, the artificial nail 2 is preferably formed with a curvature to be sufficient corresponded to the natural fingernail 3. The upper and lower attaching plates 10 and 20 are preferably made of a sufficient elastic metal and integrally constructed respectively.

An outer side of the upper saw teeth bars 23 and 23' are formed with an inclined upper supporting surface 25 (See FIGS. 1 and 6) and with saw teeth 22 arranged at an inside thereof. The supporting segment 21 is properly positioned at a central position.

Hereinafter, the attachment of the artificial nail attaching apparatus 1 according to the preferred embodiment of the present invention will be described by referring the accompanying drawings.

Figure 3:
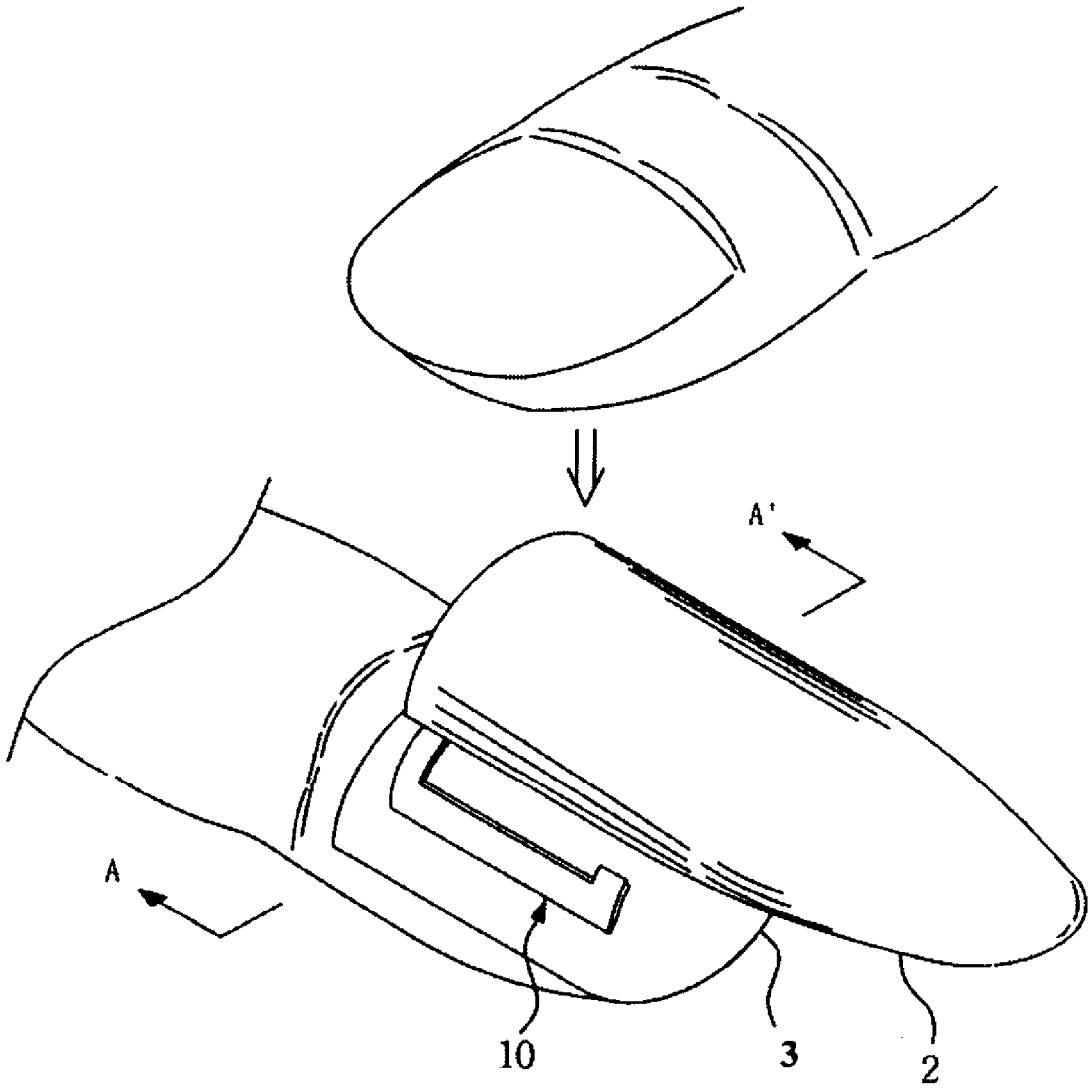
FIG. 3 is a view showing a state that the artificial nail attaching apparatus of the preferred embodiment of the present invention is worn on the natural fingernail.
Figure 4A:
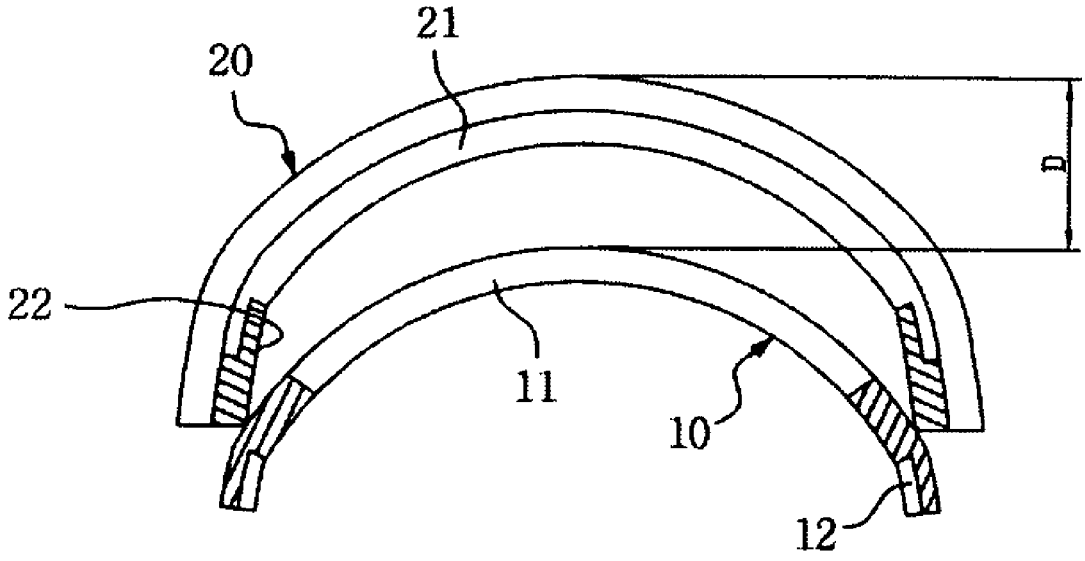
FIG. 4A is a cross-sectional view taken along the line A–A' in FIG. 3 showing a state that the artificial nail attaching apparatus of the preferred embodiment of the present invention is not worn on the natural fingernail.
Figure 4B:
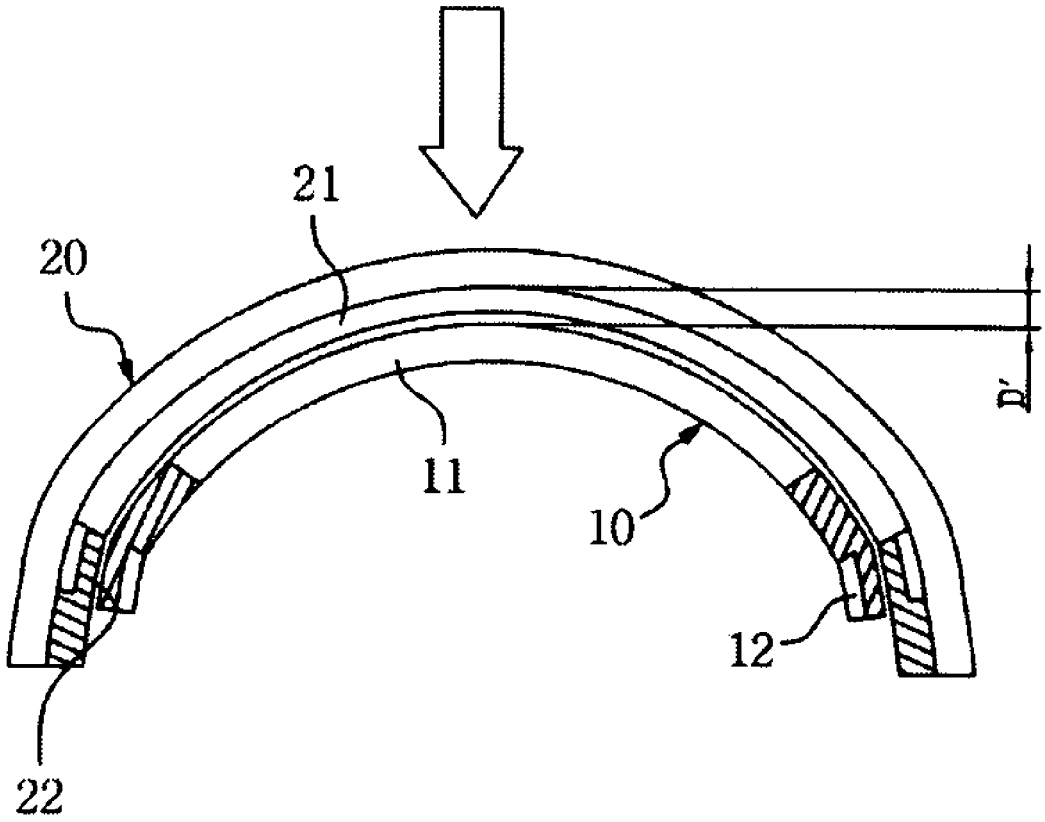
FIG. 4B is a cross-sectional view taken along the line A–A' in FIG. 3 showing a state that the artificial nail attaching apparatus of the preferred embodiment of the present invention is worn on the natural fingernail.
Figure 4C:
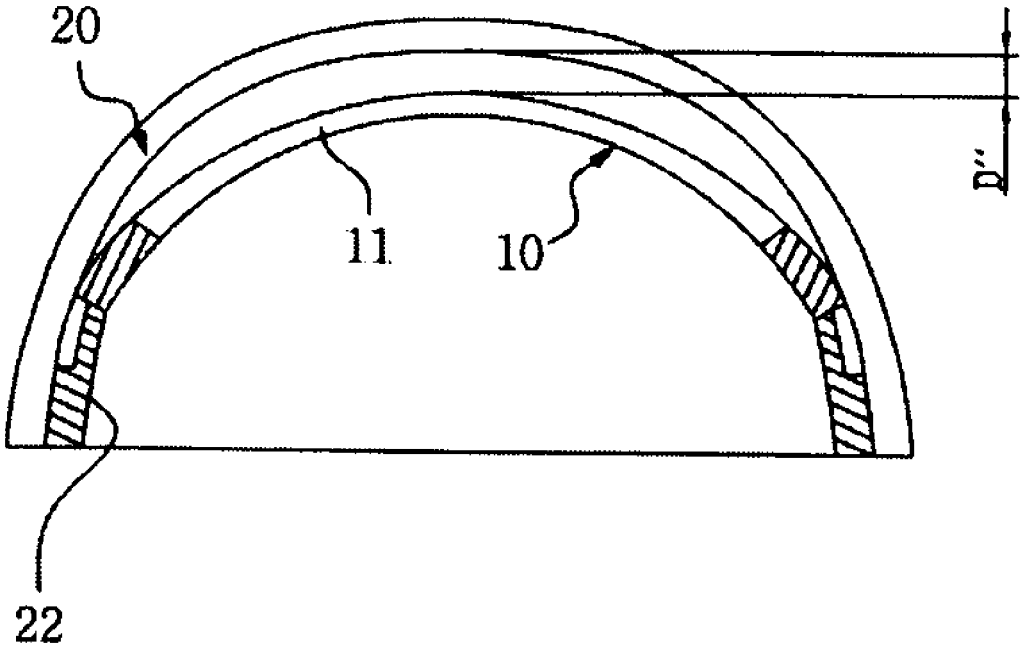
FIG. 4C is a cross-sectional view taken along the line A–A' in FIG. 3 showing a state that the artificial nail attaching apparatus of the preferred embodiment of the present invention is worn on the natural fingernail.

FIG. 3 is a view showing a state that the artificial nail attaching apparatus of the preferred embodiment of the present invention is worn on the natural fingernail, FIG. 4A is a cross-sectional view taken along the line A–A' in FIG. 3 showing a state that the artificial nail attaching apparatus of the preferred embodiment of the present invention is not worn on the natural fingernail, FIG. 4B is a cross-sectional view taken along the line A–A' in FIG. 3 showing a state that the artificial nail attaching apparatus of the preferred embodiment of the present invention is worn on the natural fingernail, and FIG. 4C is a cross-sectional view taken along the line A–A' in FIG. 3 showing a state that the artificial nail attaching apparatus of the preferred embodiment of the present invention is worn on the natural fingernail.

As shown in FIG. 3, the artificial nail attaching apparatus 1 is worn by attaching the respective attaching plates 10 and 20 separately. At that time, the attachment position of the attaching plates 10 and 20 are exactly corresponded to each other. Next, pressing an upper side of the artificial nail 2 by other finger, the artificial nail 2 can be easily attached on the natural fingernail 3.

As another example of the artificial nail attaching apparatus 1 of the present invention (not shown), after the respect attaching plates 10 and 20 are previously engaged and the engaged attaching plates 10 and 20 are attached on the artificial nail 2, the artificial nail 2 can be attached on the natural fingernail 3 by checking the proper attaching position on the natural fingernail 3.

Next, the attaching state of the respective attaching plates 10 and 20 of the artificial nail attaching apparatus 1 is described in detail by separating before wearing, in wearing, and after wearing as follows.

FIG. 4A shows the state before the respective attaching plates 10 and 20 are attached, the upper attaching plate 20 is located on the lower attaching plate 10 attached on the natural fingernail 3 (See FIG. 3). At that time, since external force (pressing force) does not apply the artificial nail 2 (FIG. 3), the shape of the artificial nail 2 does not deformed. Therefore, since the respective saw teeth 12 and 22 are not engaged, the natural fingernail 3 and the artificial nail 2 are located at a space D and the upper saw teeth 22 are positioned over the lower saw teeth 12.

FIG. 4B shows the state in wearing the respective attaching plates 10 and 20, if pressing the upper side of the artificial nail 2, both sides of the upper attaching plate 20 are spread out and the artificial nail 2 goes down along outer surface of the lower attaching plate 10 by maintaining a predetermined space D'. At that time, the respective saw teeth 12 and 22 are at a state very before engaging, and the upper saw teeth 22 are located a lower side of the lower saw teeth 12. Since the upper saw teeth 22 of the upper attaching plate 20 are not engaged with the lower saw teeth 12, the artificial nail 2 can be moved forward and rearward so that the detachment of the artificial nail 2 at a state of the use of the artificial nail 2 be described later is performed under this state. Here, the difference between the space D before the wearing and the space D' in wearing is a minimum gap for engagement of the respective saw teeth 12 and 22.

FIG. 4C shows the state after wearing the respective attaching plates 10 and 20, as shown, the upper attaching plate 20 and the lower attaching plate 10 are engaged with each other by maintaining a predetermined space D". Described in detail, since the upper saw teeth 22 are engaged with the lower saw teeth 12, the upper saw teeth cannot be moved forward and rearward so that the artificial nail 2 (See FIG. 3) keeps the wearing state. At that time, the artificial nail 2 is contracted inward by the elastic force and applied upward with restitution so that the respective saw teeth 12 and 22 are not separated and the engaging state can be kept. Here, the difference between the space D before the wearing and the space D" after wearing is a minimum space for separation of the respective saw teeth 12 and 22, the difference should be always maintained more the difference simultaneously the elastic restitution of the artificial nail 2 should be guaranteed with amount for maintaining the space difference.

Hereinafter, the use of the artificial nail attaching apparatus 1 attached by the above described construction and the attaching process by reference with the accompanying drawings in detail.

Figure 5:
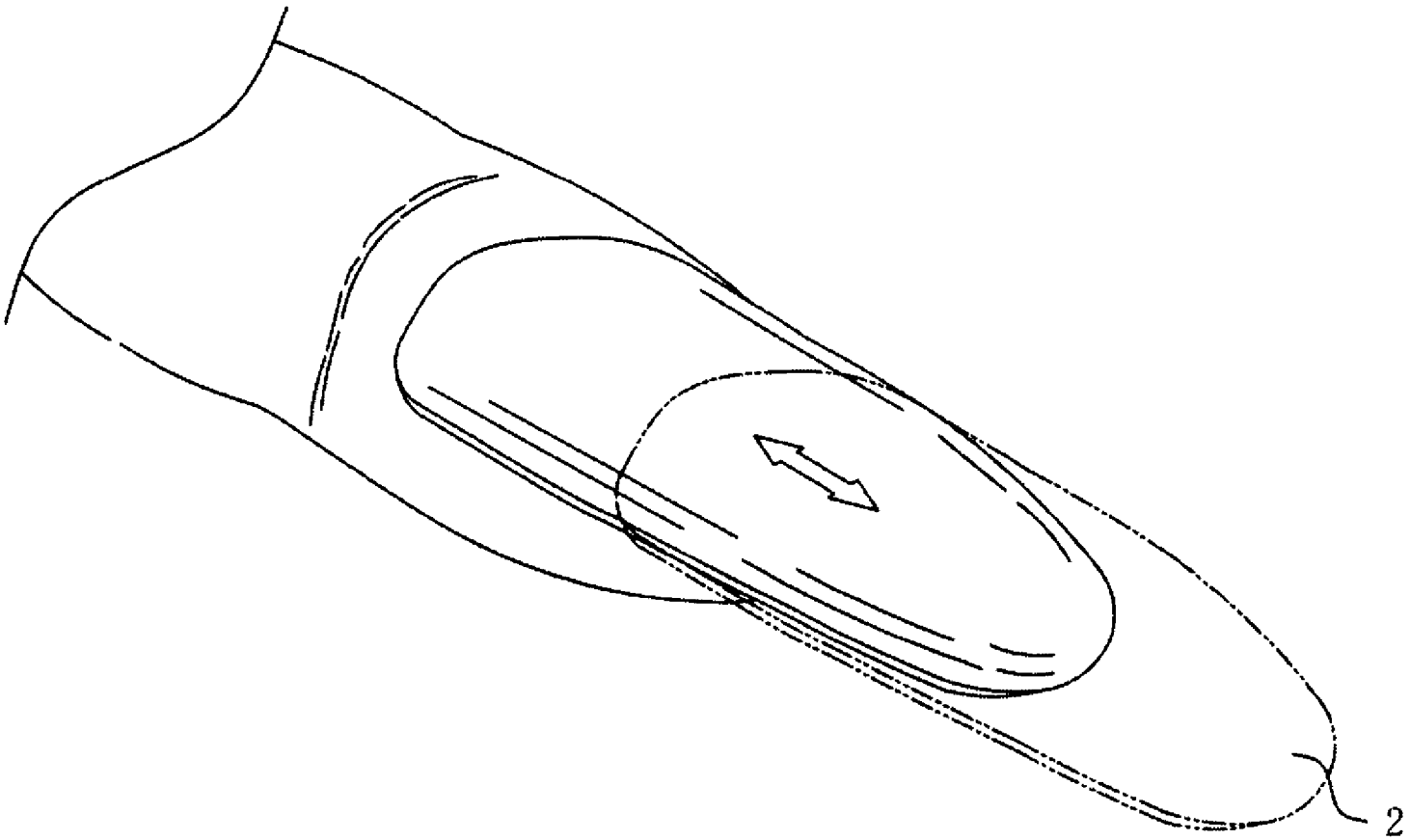
FIG. 5 is a view illustrating the use of the artificial nail attaching apparatus of the present invention.
Figure 6:
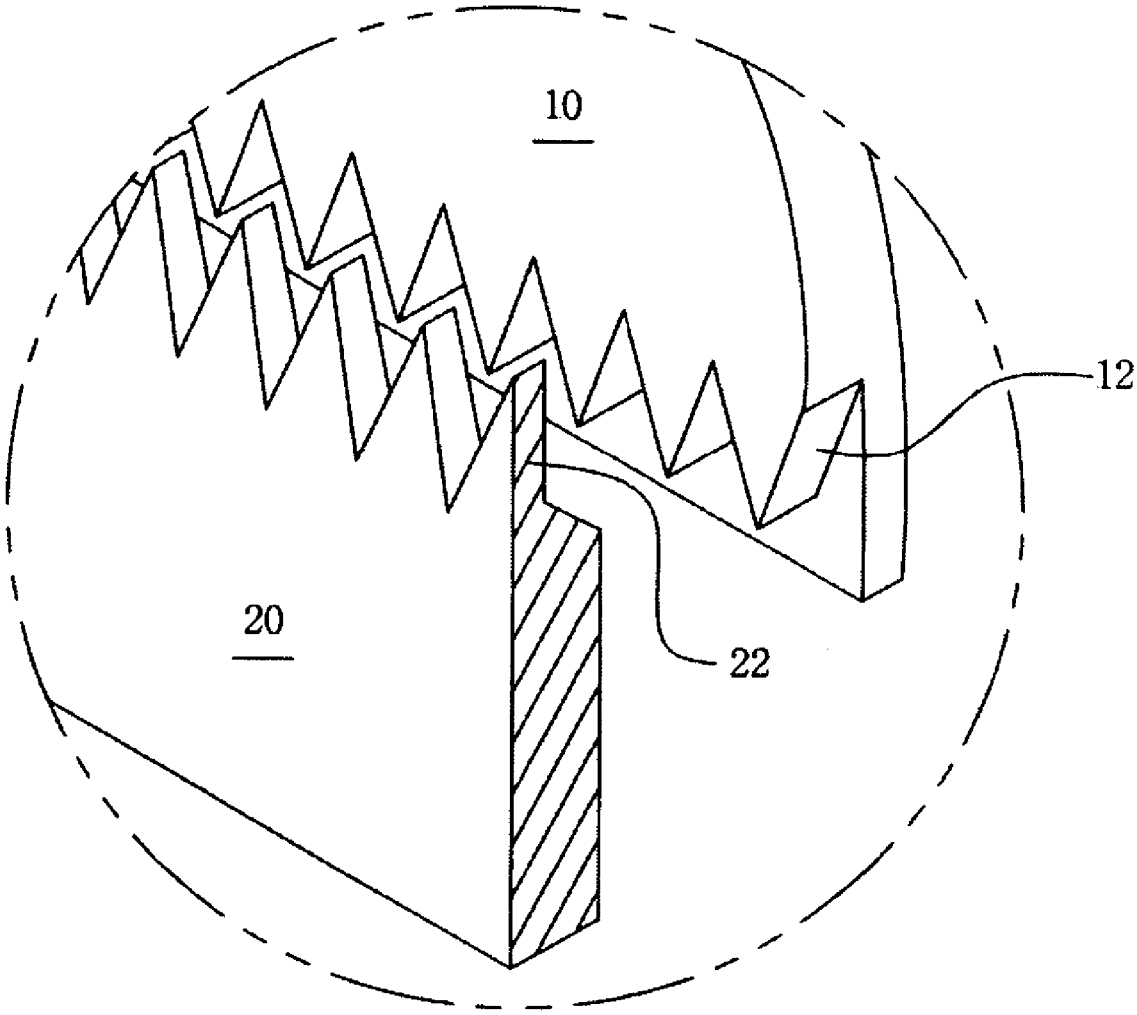
FIG. 6 is a partially cross-sectional view showing engaged saw teeth portion of the artificial nail attaching apparatus of the preferred embodiment of the present invention.

FIG. 5 shows the state of the use of the artificial nail 2 according to the present invention, and FIG. 6 shows a partial cross-sectional view illustrating the engagement of the saw teeth part of the artificial nail 2 according to the preferred embodiment.

At the state of wearing of the artificial nail 1 shown in FIG. 5, if the upper side of the artificial nail 2 is pressed such a way shown in FIG. 4B, the respective saw teeth 12 and 22 are released and separated from the engagement as shown in FIG. 6, so that the position of the artificial nail 2 can be adjusted and the artificial nail 2 can be perfectly detached by moving the artificial nail forward and rearward.

Figure 7:
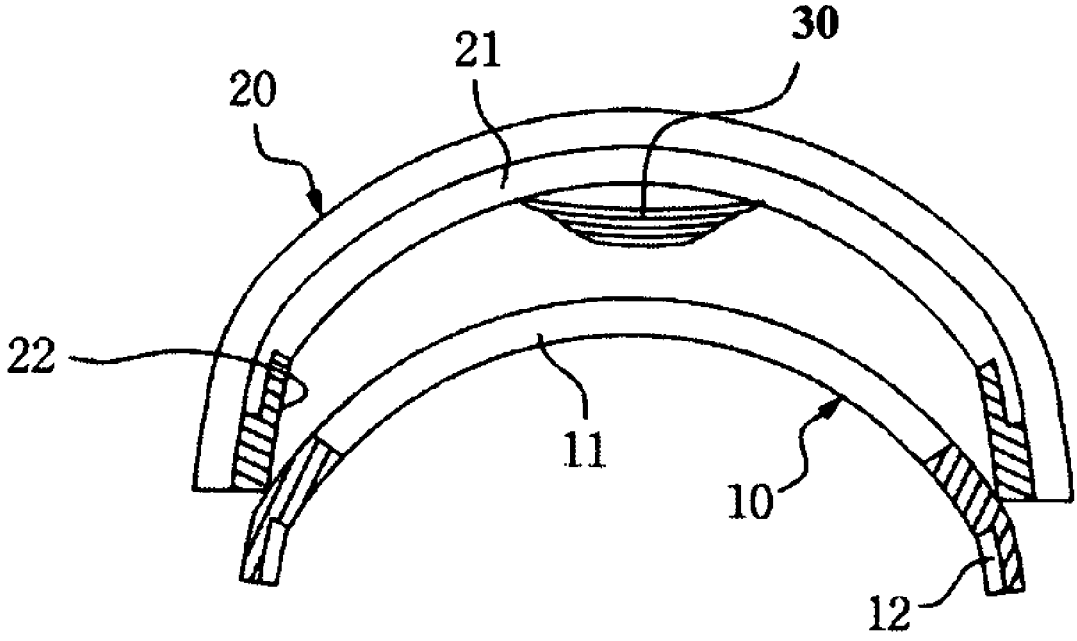
FIG. 7 is a cross-sectional view of the artificial nail attaching apparatus according to a further preferred embodiment of the present invention.

Meanwhile, as described above like in FIG. 7, as further preferred embodiment of the artificial nail 2 of the present invention, after the wearing, if, for the purpose of increasing the elastic restitution of the artificial nail 2, a spring member 30 is added to on the lower side of the artificial nail 2 and the artificial nail 2 is attached, since the artificial nail 2 is moved upward while supporting the upper surface of the natural fingernail 3, the respective saw teeth 12 and 22 are securely engaged.

Therefore, according to the artificial nail attaching apparatus 1 of the construction as described above, since by attaching the upper and lower attaching plates 10 and 20 on the artificial nail 2 and the natural fingernail 3, a variety of artificial nails 2 can be easily detached and changed according to user's favorites at any time, as well as since the position of the artificial nail 2 can be easily adjusted according to the growth of the natural fingernail 3, the grown natural fingernail 3 can be always covered by the artificial nail 2, so that a sense of beauty can be maintained at a optimal state and the artificial nail 2 can be used for a long time.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An apparatus for attaching an artificial nail on a natural fingernail comprising:

a lower attaching plate adapted to be affixed on an upper side of the natural fingernail; and an upper attaching plate adapted to be affixed on a lower side of the artificial nail wherein the upper attaching plate engages the lower attaching plate to position and attach the artificial nail on the natural fingernail.

2. The apparatus as claimed in claim 1, wherein the upper attaching plate has a supporting segment with a curvature corresponding to a curvature portion of the artificial nail and a pair of saw teeth bars having a plurality of saw teeth formed on both sides of the supporting segment in parallel, and the lower attaching plate has a front supporting segment with a curvature corresponding to a curvature portion of the natural fingernail, a pair of saw teeth bars extended from the front supporting segments in parallel with a plurality of saw teeth, and a pair of rear supporting segments formed on opposite end sides of the saw teeth bars.

3. The apparatus as claimed in claim 1, further comprising a spring member attached on the lower side of the artificial nail.

4. The apparatus as claimed in claim 1 wherein the upper attaching plate is affixed on the lower side of the artificial nail.

* * * * *